US007081305B2

(12) United States Patent
Distler et al.

(10) Patent No.: US 7,081,305 B2
(45) Date of Patent: Jul. 25, 2006

(54) PAPER COATING SLURRIES FOR CAST COATING

(75) Inventors: Dieter Distler, Bietigheim-Bissingen (DE); Volker Schaedler, Mannheim (DE); Titus Leman, Jakarta (ID); Thomas Steinmacher, Obersulm (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 10/484,720

(22) PCT Filed: Jul. 17, 2002

(86) PCT No.: PCT/EP02/07934

§ 371 (c)(1),
(2), (4) Date: Jan. 26, 2004

(87) PCT Pub. No.: WO03/012199

PCT Pub. Date: Feb. 13, 2003

(65) Prior Publication Data

US 2004/0175590 A1 Sep. 9, 2004

(30) Foreign Application Priority Data

Jul. 25, 2001 (DE) ..... 101 35 380

(51) Int. Cl.
*D21H 19/44* (2006.01)

(52) U.S. Cl. ..... 428/514; 427/361; 427/362; 427/365; 524/457

(58) Field of Classification Search ..... 427/361, 427/362, 365; 428/514; 524/457
See application file for complete search history.

(56) References Cited

U.S. PATENT DOCUMENTS

| | | | | |
|---|---|---|---|---|
| 3,356,517 | A | 12/1967 | Shimizu et al. | |
| 5,658,981 | A | 8/1997 | Ohsumi | |
| 5,755,929 | A * | 5/1998 | Kuroyama et al. | 162/137 |
| 6,117,491 | A | 9/2000 | Kettunen et al. | |

FOREIGN PATENT DOCUMENTS

| | | |
|---|---|---|
| DE | 2 400 428 | 8/1974 |
| EP | 0 359 349 | 3/1990 |
| EP | 0 718 379 | 6/1996 |
| WO | 00 00528 | 1/2000 |

OTHER PUBLICATIONS

English Translation of International Preliminary Examination Report for PCT/EP02/07934, dated Oct. 16, 2003, (6 pp.).*

* cited by examiner

*Primary Examiner*—D. S. Nakarani
(74) *Attorney, Agent, or Firm*—Oblon, Spivak, McClelland, Maier & Neustadt, P.C.

(57) ABSTRACT

A paper coating slip containing a mineral pigment and an aqueous polymer dispersion as a binder, wherein the polymer dispersion is obtainable by emulsion polymerization of ethylenically unsaturated compounds (monomers) and the paper coating slip gels at above 35° C., i.e. the viscosity of the paper coating slip at from 35 to 60° C. is at least twice the viscosity at 30° C.

23 Claims, No Drawings

PAPER COATING SLURRIES FOR CAST COATING

The present invention relates to a paper coating slip containing a mineral pigment and an aqueous polymer dispersion as a binder, herein the polymer dispersion is obtainable by emulsion polymerization of ethylenically unsaturated compounds (monomers) and the paper coating slip gels at above 35° C., i.e. the viscosity of the paper coating slip at from 35 to 60° C. is at least twice the viscosity at 30° C.

The present invention furthermore relates to a process for the production of coating papers.

The production of high-quality papers having very high gloss and smoothness, for example for decorative packaging or greeting cards or labels, is often effected by the cast coating process. The cast coating process is described, for example, in U.S. Pat. No. 3,356,517.

Paper coating slips for the cast coating process contain proteins having an isoelectric point, in particular casein, as binder. The protein causes, inter alia, gelling of the paper coating slip during the cast coating process.

In the cast coating process, the paper coating slip is applied to the base paper and partially dried at from 50 to 80° C. The still moist, coated paper is calendered on a hot cylinder, in general a chromium cylinder, whose temperature is preferably above 90° C. but below 150° C. Here, the gelling of the casein permits calendering without damage to the paper and the production of a paper having particular properties, such as gloss and smoothness.

The cast coating process to date relies on the use of suitable proteins, in general casein.

Alternative paper coating slips which are suitable for the cast coating process and permit the production of papers and having an appearance of equally high quality are therefore desirable.

Thermally sensitive polymer dispersions, i.e. polymer dispersions having a highly temperature-dependent viscosity are disclosed, for example, in DE 2400428. They are recommended for various applications, in particular as binders for fiber webs.

It is an object of the present invention to provide alternative paper coating slips for the cast coating process. The paper coating slips should give papers having very high gloss, high smoothness and good printability.

We have found that this object is achieved by the paper coating slips defined at the outset.

An essential feature of the novel paper coating slip is that the total paper coating slip gels at from 35 to 60° C., i.e. the viscosity of the total paper coating slip increases sharply in this temperature range, at least to twice the value, preferably at least to 2.5, in particular to at least 3, times the viscosity of the paper coating slip at 30° C., in particular to the corresponding multiple of the value at 35° C.

The viscosity of the paper coating slip at below 30° C. or from 35° C., in particular from 30 to 10° C., is in general from 100 to 1500, preferably from 200 to 1000, mPa.s. The viscosity is generally not very temperature-dependent in this range. Gelling occurs at above 35° C.

The viscosity then increases to the abovementioned multiple in the range from 35 to 60° C. Above 60° C., often even above about 50° C., this increase ends and the temperature dependence is substantially less. The plot of the viscosity as a function of the temperature generally shows, in the range from 35 to 60° C., an S-shaped curve which is characterized by a point of inflection (referred to as the gelling point) in the middle of the gelling range.

The viscosity is preferably measured as the Brookfield viscosity (at 100 revolutions per minute) and expressed in mPa.s.

The paper coating slip contains, as a substantial constituent, an aqueous polymer dispersion as a binder.

The polymer material is obtainable by emulsion polymerization of ethylenically unsaturated compounds (monomers).

The polymer dispersed in the aqueous dispersion (referred to below as polymer for short) is composed of at least 40, in particular at least 60, particularly preferably at least 80, % by weight of main monomers selected from $C_1$- to $C_{20}$-alkyl (meth)acrylates, vinyl esters of up to 20 carbon atoms, ethylenically unsaturated nitrites, vinyl halides, vinyl ethers of alcohols of 1 to 10 carbon atoms, aliphatic hydrocarbons having 2 to 8 carbon atoms and one or two double bonds or mixtures of these monomers.

Examples are alkyl(meth)acrylates having a $C_1$–$C_{10}$-alkyl radical, such as methyl methacrylate, methyl acrylate, n-butyl acrylate, ethyl acrylate and 2-ethylhexyl acrylate.

In particular, mixtures of the alkyl (meth)acrylates are also suitable.

Vinyl esters of carboxylic acids of 1 to 20 carbon atoms are, for example, vinyl laurate, vinyl stearate, vinyl propionate, vinyl versatate and vinyl acetate.

Suitable vinylaromatic compounds are vinyltoluene, α- and β-methylstyrene, α-butylstyrene, 4-n-butylstyrene, 4-n-decylstyrene and preferably styrene. Examples of nitriles are acrylonitrile and methacrylonitrile.

The vinyl halides are chlorine-, fluorine- or bromine-substituted ethylenically unsaturated compounds, preferably vinyl chloride and vinylidene chloride.

Examples of vinyl ethers are vinyl methyl ether and vinyl isobutyl ether. Vinyl ethers of alcohols of 1 to 4 carbon atoms are preferred.

Examples of hydrocarbons having 2 to 8 carbon atoms and one double bond are ethylene and propylene, and aliphatic hydrocarbons having at least two, preferably conjugated double bonds are $C_4$- to $C_8$-hydrocarbons, such as butadiene, isoprene or chloroprene Polymers with $C_1$–$C_{20}$-alkyl(meth)acrylates, in particular $C_1$–$C_{10}$-alkyl(meth)acrylates or mixtures of these alkyl (meth)acrylates with vinylaromatics as main monomers (polyacrylate binders) are preferred.

Alternatively, polymers with aliphatic hydrocarbons having 4 to 8 carbon atoms and two conjugated double bonds or mixtures of these aliphatic hydrocarbons with vinylaromatics, in particular styrene, as main monomers (styrene (S)-butadiene (B) binder) are likewise preferred.

In addition to the main monomers, the polymer obtained by free radical polymerization may contain further monomers as structural components, for example monomers having carboxyl, sulfo or phosphonic acid groups. Carboxyl groups are preferred. Examples are acrylic acid, methacrylic acid, itaconic acid, maleic acid and fumaric acid.

Further monomers are, for example, also hydroxyl-containing monomers, in particular $C_1$–$C_{10}$-hydroxyalkyl(meth) acrylates, and (meth)acrylamide.

In addition, phenoxyethylglycol mono(meth)acrylate, glycidyl acrylate, glycidyl methacrylate and amino (meth) acrylates, such as 2-aminoethyl (meth)acrylate, may be mentioned as further monomers.

Examples of further monomers, in particular in the case of the polyacrylate binders, are also crosslinking monomers, e.g. divinylbenzene.

In a preferred embodiment, the polymers are prepared by emulsion polymerization, and the product is therefore an emulsion polymer.

However, the preparation can also be effected, for example, by solution polymerization and subsequent dispersing in water.

In the emulsion polymerization, ionic and/or nonionic emulsifiers and/or protective colloids or stabilizers are used as surface-active compounds.

A detailed description of suitable protective colloids is to be found in Houben-Weyl, Methoden der organischen Chemie, Volume XIV/1, Makromolekulare Stoffe, Georg-Thieme-Verlag, Stuttgart, 1961, pages 411 to 420. Suitable emulsifiers are anionic, cationic and nonionic emulsifiers. Emulsifiers whose molecular weight, in contrast to the protective colloids, is usually below 2000 g/mol are preferably exclusively used as accompanying surface-active substances. When mixtures of surface-active substances are used, the individual components must of course be compatible with one another, which, in the case of doubt, can be checked by means of a few preliminary experiments. Anionic and nonionic emulsifiers are preferably used as surface-active substances. Customary accompanying emulsifiers are, for example, ethoxylated fatty alcohols (degree of ethoxylation: from 3 to 50, alkyl radical: $C_8$ to $C_{36}$), ethoxylated mono-, di- and trialkylphenols (degree of ethoxylation: from 3 to 50, alkyl radical: $C_4$ to $C_9$), alkali metal salts of dialkyl esters of sulfosuccinic acid and alkali metal and ammonium salts of alkylsulfates (alkyl radical: $C_8$ to $C_{12}$), of ethoxylated alkanols (degree of ethoxylation: from 4 to 30, alkyl radical: $C_{12}$ to $C_{18}$), of ethoxylated alkylphenols (degree of ethoxylation: from 3 to 50, alkyl radical: $C_4$ to $C_9$), of alkanesulfonic acids (alkyl radical: $C_{12}$ to $C_{18}$) and of alkylarylsulfonic acids (alkyl radical: $C_9$ to $C_{18}$).

Further suitable emulsifiers are compounds of the formula II (II)

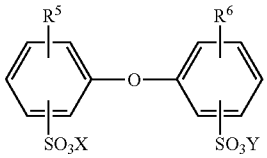

where $R^5$ and $R^6$ are hydrogen or $C_4$- to $C_{14}$-alkyl and are not simultaneously hydrogen, and X and Y may be alkali metal ions and/or ammonium ions. Preferably, $R^5$ and $R^6$ are linear or branched alkyl of 6 to 18, in particular 6, 12 or 16, carbon atoms or hydrogen, and $R^5$ and $R^6$ are not both simultaneously hydrogen. X and Y are preferably sodium, potassium or ammonium ions, sodium being particularly preferred. Particularly advantageous compounds II are those in which X and Y are sodium, $R^5$ is branched alkyl of 12 carbon atoms and $R^6$ is hydrogen or $R^5$. Frequently, industrial mixtures which contain from 50 to 90% by weight of the monoalkylated product, for example Dowfax® 2A1 (trademark of Dow Chemical Company), are frequently used.

Suitable emulsifiers are also described in Houben-Weyl, Methoden der organischen Chemie, Volume 14/1, Makromolekulare Stoffe, Georg Thieme Verlag, Stuttgart, 1961, pages 192 to 208.

Tradenames of emulsifiers are, for example, Dowfax® 2 A1, Emulan® NP 50, Dextrol® OC 50, emulsifier 825, emulsifier 825 S, Emulan® OG, Texapon® NSO, Nekanil® 904 S, Lumiten® I-RA, Lumiten E 3065, Disponil FES 77, Lutensol AT 18, Steinapol VSL and Emulphor NPS 25.

The surface-active substances are usually used in amounts of from 0.1 to 10, preferably 0.2–5, % by weight, based on the monomers to be polymerized.

Water-soluble initiators for the emulsion polymerization are, for example, ammonium and alkali metal salts of peroxodisulfuric acid, e.g. sodium peroxodisulfate, hydrogen peroxide or organic peroxides, e.g. tert-butyl hydroperoxide.

Reduction-oxidation (redox) initiator systems are also suitable.

The redox initiator system consists of at least one generally inorganic reducing agent and one inorganic or organic oxidizing agent.

The oxidizing component comprises, for example, the abovementioned initiators for the emulsion polymerization.

The reducing components are, for example, alkali metal salts of sulfurous acid, e.g. sodium sulfite or sodium hydrogen sulfite, alkali metal salts of disulfurous acid, such as sodium disulfite, bisulfite addition compounds of aliphatic aldehydes and ketones, such as acetone bisulfite, or reducing agents such as hydroxymethanesulfinic acid and its salts, or ascorbic acid. The redox initiator system can be used in the presence of soluble metal compounds whose metal components may occur in a plurality of valency states.

Conventional redox initiator systems are, for example, ascorbic acid/iron(II) sulfate/sodium peroxodisulfate, tert-butyl hydroperoxide/sodium disulfite, tert-butyl hydroperoxide/sodium hydroxymethanesulfinate. The individual components, for example the reducing component, may also be mixtures, for example a mixture of the sodium salt of hydroxymethanesulfinic acid and sodium disulfite.

Said compounds are generally used in the form of aqueous solutions, the lower concentration being determined by the amount of water acceptable in the dispersion and the upper concentration by the solubility of the relevant compound in water. In general, the concentration is from 0.1 to 30, preferably from 0.5 to 20, particularly preferably from 1.0 to 10, % by weight, based on the solution.

The amount of the initiators is in general from 0.1 to 10, preferably from 0.5 to 5, % by weight, based on the monomers to be polymerized. A plurality of different initiators may also be used in the emulsion polymerization.

In the polymerization, it is possible to use regulators, for example in amounts of from 0 to 1.2 parts by weight, based on 100 parts by weight of the monomers to be polymerized, by which the molar mass is reduced. For example, compounds having a thiol group, such as tert-butyl mercaptan, ethyl thioglycolate, mercaptoethynol, mercaptopropyltrimethoxysilane or tert-dodecyl mercaptan.

The emulsion polymerization is effected as a rule at from 30 to 130° C., preferably from 50 to 90° C. The polymerization medium may consist either only of water or of mixtures of water and liquids miscible therewith, such as methanol. Preferably, only water is used. Emulsion polymerization can be carried out both as a batch process and in the form of a feed process, including a step or gradient procedure. The feed process in which a part of the polymerization batch is initially taken, heated to the polymerization temperature and prepolymerized and then the remainder of the polymerization batch is fed to the polymerization zone continuously, stepwise or with superposition of a concentration gradient while maintaining the polymerization, usually via a plurality of spatially separated feeds, one or more of which contain the monomers in pure or in emulsified form, is preferred. In the polymerization, a polymer may also be initially taken, for example for more readily establishing the particle size.

The manner in which the initiator is added to the polymerization vessel in the course of the free radical aqueous polymerization is known to an average person skilled in the art. It may be either completely initially taken in the polymerization vessel or used continuously or stepwise at the rate at which it is consumed in the course of the free radical aqueous emulsion polymerization. This depends specifically on the chemical nature of the initiator system as well as on the polymerization temperature. Preferably, a part is initially taken and the remainder is added at the rate of consumption to the polymerization zone.

In order to remove the residual monomers, initiator is usually also added after the end of the actual emulsion polymerization, i.e. after a conversion of the monomers of at least 95%.

In the feed process, the individual components can be added to the reactor from above, from the side or from below through the reactor base.

In the emulsion polymerization, aqueous dispersions of the polymer, as a rule having solids contents of from 15 to 75, preferably from 40 to 75, % by weight are obtained.

For a high space/time yield of the reactor, dispersions having a very high solids content are preferred. To be able to achieve solids contents >60% by weight, a bimodal or polymodal particle size should be established, since otherwise the viscosity is too high and the dispersion can no longer be handled. The production of a fresh particle generation can be effected, for example, by adding seed (EP 81083), by adding excess amounts of emulsifier or by adding miniemulsions. A further advantage associated with the low viscosity at high solids content is the improved coating behavior at high solids contents. The production of a fresh particle generation or of fresh particle generations can be effected at any desired time. It depends on the particle size distribution which is aimed at in order to achieve a low viscosity.

The polymer thus prepared is preferably used in the form of its aqueous dispersion.

The glass transition temperature of the polymer or of the emulsion polymer is preferably from −60 to +60° C., particularly preferably from −30 to +30° C., very particularly preferably from −20 to +10° C.

The glass transition temperature can be determined by conventional methods, such as differential thermal analysis or differential scanning calorimetry (cf. for example ASTM 3418/82, midpoint temperature).

A further important constituent of the paper coating slip is a pigment, in particular a white pigment, which subsequently imparts the particularly desired color to the coated paper.

Known white pigments are, for example, barium sulfate, calcium carbonate, calcium sulfoaluminate, kaolin, talc, titanium dioxide, zinc oxide, chalk, coating clay and satin white.

The paper coating slip may furthermore contain, if required, assistants such as thickeners, antifoams, biocides and also auxiliary binders or cobinders, such as starch or cellulose.

Paper coating slips predominantly comprise the pigment. The paper coating slip therefore generally contains from 1 to 40, preferably from 8 to 25, parts by weight, based on 100 parts by weight of pigment, of polymer (solid, i.e. without water).

The novel paper coating slip preferably contains less than 3 parts by weight of proteins, e.g. casein, based on 100 parts by weight of pigment; particularly preferably, it contains less than 1 part by weight of proteins, very particularly preferably no proteins, e.g. no casein.

The novel paper coating slip exhibits gelling of the total paper coating slip (see above) even without casein or other proteins as binder.

For this purpose, at least one of the constituents of the paper coating slip or at least one of the structural components of one of the constituents of the paper coating slip preferably has a temperature-dependent light transmittance such that there is a temperature range bounded by the temperatures T1 (lower temperature) and T2 (higher temperature) in which the light transmittance of an aqueous solution which contains this constituent or this structural component decreases to less than 80% of the light transmittance at T1.

The temperature range T1 to T2 preferably comprises not more than 15° C., in particular not more than 10° C.

The light transmittance of the constituent or of the structural components of the constituent (summarized below as component having temperature-dependent light transmittance) decreases in this temperature range to less than 80%, in particular less than 50%, very particularly preferably less than 30%, of the light transmittance at T1.

The temperature range T1 to T2 is preferably in the same temperature range in which the viscosity is to increase, i.e. the paper coating slip gels.

The turbidity is determined using a 5% strength by weight solution or emulsion of the components in water.

If the components having temperature-dependent light transmittance are a monomer as a constituent of the polymer, it is not the monomer as such but its homopolymer having a number average molecular weight of from 1000 to 20,000 (gel permeation chromatography, $H_2O$, acrylamide standard) which is used in the determination of the turbidity.

Preferably, the components having temperature-dependent light transmittance are a) polymeric compounds which are added to the dispersion as an additive, b) an emulsifier for stabilizing the polymer, which emulsifier is preferably used during the polymerization itself, or c) a monomer as a structural component of the polymer.

Suitable polymeric compounds a) are in particular those which, owing to their temperature-dependent solubility in water, have a corresponding turbidity range T1 to T2.

Examples are in particular compounds which contain alkoxy groups, preferably ethylene oxide or propylene oxide groups, quaternary ammonium groups, siloxane groups (Si—O) or combinations of these groups.

For example, compounds having at least 2, preferably at least 4, quaternary ammonium groups, in particular those of the formula I

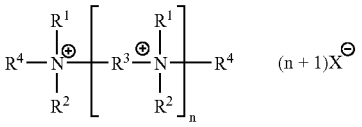

where $R^1$, $R^2$ and $R^4$, independently of one another, are a hydrogen atom or a monovalent organic radical of, preferably, 1 to 10 carbon atoms and $R^3$ is a divalent organic radical of 1 to 10 carbon atoms, are suitable.

Examples are compounds having alkylene oxide side groups, e.g. polyvinyl ethers.

Polysiloxanes are also particularly suitable.

Compounds a) having combinations of the above groups, in particular those having ammonium groups and alkylene oxide groups or those having siloxane groups and alkylene oxide groups, are particularly suitable.

For example, polyvinyl ether/polysiloxane block copolymers (TEGO Coagulant from Goldschmidt) are commercially available.

The molecular weight of the polymeric compound is in general from 500 to 50 000 g/mol (number average molecular weight determined by gel permeation chromatography, PEG standard, solvent $H_2O$).

Low molecular weight compounds a) having a number average molecular weight of less than 10 000, in particular less than 5 000 or less than 3 000, g/mol are particularly preferred.

Preferred compounds a) contain 0.05–40 g of silicon (Si) in the form of siloxane groups and/or from 0.1 to 30 g of oxygen in the form of alkoxy groups and/or from 0.05 to 20 g of nitrogen in the form of quaternary ammonium groups, based on 100 g of the compound a). The total amount of silicon, oxygen and/or nitrogen in the form of the above groups is preferably from 0.1 to 40 g per 100 g; the minimum content altogether is particularly preferably 0.5, in particular 2, very particularly preferably 5, g per 100 g of compound a), and an amount of 30 g of silicon, oxygen and nitrogen altogether is preferably not exceeded.

Examples of emulsifiers b) are emulsifiers which likewise contain at least one siloxane group, ammonium group or alkylene oxide group.

Monomer c) is, for example, N-isopropylacrylamide.

Preferably, the component a) having temperature-dependent light transmittance is used in combination with an ionically stabilized polymer dispersion.

Preferably, sulfate or sulfamate groups are suitable for the ionic stabilization of the polymer dispersion. In particular, emulsifiers having such groups are used in the emulsion polymerization (see above).

The amount of the compound a) is preferably from 0.5 to 10, particularly preferably from 1 to 5, parts by weight per 100 parts by weight of polymer.

For the preparation of the paper coating slip, the constituents can be mixed in a known manner.

The paper coating slips are aqueous paper coating slips. The water content can be established according to the desired viscosity or leveling properties.

The pH of the paper coating slip is preferably brought to a pH of greater than 7, in particular greater than 8.

The paper coating slips are suitable for coating, for example, paper or cardboard. The paper coating slip can then be applied by conventional methods to the papers or cardboard to be coated.

The amount applied is in general from 1 to 30, preferably from 10 to 25, g/m$^2$ (solid, without water).

The novel paper coating slips are particularly suitable for the cast coating process.

The essential feature of these coating methods is that the paper coating slip gels during the coating process and the coated paper is brought into contact with a metal cylinder, preferably a chromium cylinder, in particular is calendered over this cylinder.

Known cast coating processes are the Warren and the Champion process.

Common to the cast coating processes is that the base paper is first coated with a paper coating slip, drying of the coating is effected, residual water preferably remaining in the coating, and the coated paper is then calendered over a metal cylinder, preferably a chromium cylinder.

For calendering, the coated paper preferably first runs over a pressure roller which presses the coated paper against the metal cylinder.

If required, water is fed in before or during calendering, in order to keep the coating moist.

The temperature of the metal cylinder is preferably from 90 to 150° C.

As a result of the cast coating process, the coated papers acquire particular properties, such as high gloss and high smoothness. The papers are particularly suitable as decorative papers or high-quality packaging papers or labels, for example for perfume, for publicity purposes, etc.

The novel paper coating slips are very suitable for the cast coating process. The papers coated with the novel paper coating slips have the desired properties, such as gloss and smoothness, to a considerable extent.

The coated papers can be readily printed by the conventional printing processes, for example by the offset, letterpress or gravure printing process.

EXAMPLES

1) Preparation of the Latices:

Latex 1

300 g of water, 32 g of a 33% strength by weight polymer ($d_{50}$ 30 nm) and 10% of the initiator solution (feed 2) were initially taken in a polymerization vessel and heated to 70° C.

The monomer emulsion and the residual amount of initiator solution were then added in the course of 5.5 hours, beginning simultaneously, via two separate feeds, while maintaining the temperature in the polymerization vessel. After the end of the monomer addition, cooling to 60° C. was effected and 4 g of tert-butyl hydroperoxide in 70 g of water and a solution of 2.5 g of acetone and 7 g of a 40% strength by weight solution of sodium disulfite in 84 g of water were added in the course of 2 hours while maintaining the temperature. 60 g of a 25% strength by weight sodium hydroxide solution were then added. Cooling to room temperature was then effected.

| | |
|---|---|
| | Feed 1: |
| 970 g | of demineralized water |
| 24 g | of sodium lauryl sulfate, 28% strength by weight in water |
| 700 g | of styrene |
| 100 g | of acrylonitrile |
| 630 g | of butadiene |
| 15 g | of tert-dodecyl mercaptan |
| 45 g | of methacrylic acid |
| 10 g | of 25% strength by weight aqueous sodium hydroxide solution |
| | Feed 2: |
| 15.0 g | of sodium peroxodisulfate in 210 g of water |

The solids content of the dispersion was about 50% by weight. The light transmittance was 44%. The weight average particle size $d_{50}$ was 170 nm. The pH was 6.2 and the glass transition temperature was 5° C.

Latex 2

321 g of water, 22.3 g of a 33% strength by weight polymer ($d_{50}$ 30 nm), 180 g of acrylonitrile and 180 g of butadiene were initially taken in a polymerization vessel and heated to 65° C. When the required temperature had been reached, 2.25 g of sodium peroxodisulfate in the form of a 10% strength by weight aqueous solution were added to initiate the reaction.

The monomer emulsion and 2.25 g of sodium peroxodisulfate in 27 g of water were then added in the course of 6 hours, beginning simultaneously, via two separate feeds, while maintaining the temperature in the polymerization vessel. After the end of the monomer addition, 4 g of tert-butyl hydroperoxide in 70 g of water and a solution of 2.5 g of acetone and 7 g of a 40% strength by weight solution of sodium disulfite in 84 g of water were added in the course of 2 hours while maintaining the temperature. 23 g of a 10% strength by weight sodium hydroxide solution were then added. Cooling to room temperature was then effected.

Monomer Emulsion:

| | |
|---|---|
| 860 g | of demineralized water |
| 60 g | of sodium lauryl sulfate, 15% strength by weight in water |
| 735 g | of butadiene |
| 210 g | of acrylonitrile |
| 150 g | of styrene |
| 45 g | of methacrylic acid |
| 12 g | of tert-dodecyl mercaptan |

The solids content of the dispersion was about 50% by weight. The light transmittance was 60%. The weight average particle size $d_{50}$ was 180 nm. The pH was 7.7 and the glass transition temperature was −15° C.

Latex 3

Analogous to latex 2, except that, instead of sodium lauryl sulfate, 112 g of a 40% strength by weight solution of Texapon K30 (ethoxylated sodium alkyl sulfate, Henkel) in water were used in the monomer emulsion.

Latex 4

Analogous to latex 3, except that 620 g of butadiene and 265 g of styrene were used in the monomer emulsion.

The glass transition temperature of this polymer was 2° C.

2) Formulation of the Paper Coating Slip

The paper coating slip was prepared by mixing the constituents according to table 1

TABLE 1

| | Solids content (%) | Ex. 1* | Ex. 2* | Ex. 3 | Ex. 4 | Ex. 5 | Ex. 6 |
|---|---|---|---|---|---|---|---|
| Amazone 88[1] | 74 | 100 | 100 | 100 | 100 | 100 | 100 |
| Casein | 21 | 12 | — | — | — | — | — |
| Ammonium nitrate | 50 | 1.2 | — | — | — | — | — |
| Tributyl phosphate | 100 | 0.4 | — | — | — | — | — |
| Ammonia | 25 | 0.16 | — | — | — | — | — |
| Latex 1 | 50 | 12 | — | — | — | — | 8 |
| Latex 2 | 50 | — | 20 | 20 | — | — | 12 |
| Latex 3 | 50 | — | — | — | 20 | — | — |
| Latex 4 | 50 | — | — | — | — | 20 | — |
| Coagulation reagent[2] | 10 | — | — | 0.5 | 0.5 | 0.5 | 0.5 |
| Calcium formate | 10 | 0.5 to 2 | — | — | — | — | — |
| Solids content of the coating slip (%) | | 42 | 61 | 61 | 61 | 61 | 61 |

*for comparison
[1]White pigment
[2]TEGO Coagulant 4710 from Goldschmidt, turbidity temperature 40° C. (siloxane/vinyl ether block copolymer)

Gelling

The viscosity of the paper coating slip was measured as stated above in the description and the gelling point was determined.

| Example | Gelling point/° C. |
|---|---|
| 1 | 40 |
| 2 | — |
| 3 | 35 |
| 4 | 37 |
| 5 | 36 |
| 6 | 38 |

3. Further Examples

Latex 5

Analogous to latex 2, except that 120 g of acrylonitrile, 30 g of styrene and 180 g of butadiene were initially taken; instead of sodium lauryl sulfate, the monomer emulsion contained 113 g of a 40% strength solution of emulsifier K30 in water, 210 g of styrene and 180 g of acrylonitrile but was otherwise the same as latex 2. After the reaction mixture had been cooled, 37 g of a 40% strength solution of emulsifier K30 in water were added to it.

The solids content of the dispersion was about 50% by weight. The light transmittance was 50%. The weight average particle size $d_{50}$ was 180 nm. The pH was 7.8 and the glass transition temperature was −24° C.

Latex 6

Analogous to latex 5, except that the initially taken mixture contained 120 g instead of 180 g of butadiene; the feed contained 375 g instead of 210 g of styrene and 630 instead of 735 g of butadiene; otherwise as for latex 5.

The solids content of the dispersion was brought to 45% by weight. The light transmittance was 50%. The weight average particle size $d_{50}$ was 185 nm. The pH was 7.1 and the glass transition temperature was −5° C.

4. Production of the Coated Papers by the Cast Coating Process

The coated papers were produced with the aid of a laboratory cast coating apparatus comprising application unit, pressure roller and chromium cylinder.

The gloss of the coated papers was then measured according to Lehmann.

| | Example 7 | Example 8 |
|---|---|---|
| SPS[1] | 100 | 100 |
| Casein | — | — |
| Latex 5 | 20 | |
| Latex 6 | | 20 |
| Coagulation reagent[2] | 0.5 | 0.5 |
| Solids content of the coating slip (%) | 53 | 53 |
| Gelling point | 49 | 45 |
| Paper gloss (Lehmann, 75°) | 76.2 | 84 |

[1]White pigment
[2]TEGO Coagulant 4710, Goldschmidt AG

The gloss obtained corresponds to a high degree to the requirements which high-quality papers as obtained by the cast coating process have to meet.

We claim:

1. A process for the production of coated papers, comprising:

applying at least one aqueous paper coating slip to a base paper by cast coating to form a coated paper and contacting the coated paper with a metal cylinder heated to at least 90° C., wherein the paper coating slip comprises a mineral pigment and an aqueous polymer dispersion, and wherein the polymer dispersion is obtained by emulsion polymerization of at least one ethylenically unsaturated compound;

wherein the viscosity of the paper coating slip at from 35° C. to 60° C. is at least twice the viscosity at 30° C.; and wherein the paper coating slip comprises one of the following constituents:

a) an ionically stabilized polymer dispersion and a polymeric compound having a temperature-dependent light transmittance, b) an aqueous polymer dispersion stabilized with a nonionic emulsifier, wherein the emulsifier has a temperature-dependent light transmittance, or c) an aqueous polymer dispersion in which the dispersed polymer contains polymerized units of a monomer whose homopolymer has a temperature-dependent light transmittance, wherein temperature-dependent light transmittance is a temperature range bounded by a lower temperature T1 and higher temperature T2 wherein the light transmittance at T2 is less than 80% of the light transmittance at T1; and wherein T1 is 30° C. and T2 ranges from 35° C. to 60° C.

2. The process as claimed in claim 1, wherein said paper coating slip comprising a polymeric compound a) having a temperature-dependent light transmittance wherein a temperature range bounded by a lower temperature T1 and a higher temperature T2 the light transmittance at T2 is less than 80% of the light transmittance at T1, and has a corresponding turbidity range T1 to T2.

3. The process as claimed in claim 1, wherein the polymer dispersion comprises a polymer comprising polymerized units of at least 40% by weight of one or more main monomers selected from the group consisting of a $C_1$- to $C_{20}$-alkyl (meth)acrylate, a vinyl ester of carboxylic acid of up to 20 carbon atoms, a vinylaromatic of up to 20 carbon atoms, an ethylenically unsaturated nitrile, a vinyl halide, a vinyl ether of an alcohol of 1 to 10 carbon atoms, an aliphatic hydrocarbon having 2 to 8 carbon atoms and one or two double bonds and mixtures thereof.

4. The process as claimed in claim 1, wherein the polymer dispersion comprises a polymer having a glass transition temperature of from −60° C. to +60° C.

5. The process as claimed in claim 1, wherein the paper coating slip has a pH of greater than 7.

6. The process as claimed in claim 1, wherein the paper coating slip comprises a) and the polymeric compound is water-soluble at 21° C. and has polyether groups.

7. The process as claimed in claim 1, wherein the paper coating slip contains no protein.

8. A coated paper obtained by the process as claimed in claim 1.

9. The process as claimed in claim 1, wherein the metal cylinder is chromium.

10. The process as claimed in claim 1, wherein the paper coating slip contains no casein.

11. A paper coating slip comprising a mineral pigment and an aqueous polymer dispersion, said polymer dispersion obtained by emulsion polymerization of at least one ethylenically unsaturated compound wherein the viscosity of the paper coating slip between 35° C. and 60° C. is at least twice the viscosity at 30° C., and said paper coating slip comprising a polymeric compound a) having a temperature-dependent light transmittance wherein a temperature range bounded by a lower temperature T1 and a higher temperature T2 the light transmittance at T2 is less than 80% of the light transmittance at T1, and has a corresponding turbidity range T1 to T2; and wherein T1 is 30° C. and T2 ranges from 35° C. to 60° C.

12. The paper slip coating as claimed in claim 11, which further comprises one of the following constituents:

a) an ionically stabilized polymer dispersion and a polymeric compound having a temperature-dependent light transmittance, b) an aqueous polymer dispersion stabilized with a nonionic emulsifier, wherein the emulsifier has a temperature-dependent light transmittance, or c) an aqueous polymer dispersion in which the dispersed polymer contains polymerized units of a monomer whose homopolymer has a temperature-dependent light transmittance.

13. The paper slip coating as claimed in claim 12, wherein the paper coating slip comprises a) and the polymeric compound is water-soluble at 21° C. and has polyether groups.

14. The paper slip coating as claimed in claim 11, wherein the polymer dispersion comprises a polymer comprising polymerized units of at least 40% by weight of one or more main monomers selected from the group consisting of a $C_1$- to $C_{20}$-alkyl (meth)acrylate, a vinyl ester of carboxylic acid of up to 20 carbon atoms, a vinylaromatic of up to 20 carbon atoms, an ethylenically unsaturated nitrile, a vinyl halide, a vinyl ether of an alcohol of 1 to 10 carbon atoms, an aliphatic hydrocarbon having 2 to 8 carbon atoms and one or two double bonds and mixtures thereof.

15. The paper slip coating as claimed in claim 11, wherein the polymer dispersion comprises a polymer having a glass transition temperature of from −60° C. to +60° C.

16. The paper slip coating as claimed in claim 11, wherein the paper coating slip has a pH of greater than 7.

17. The paper slip coating as claimed in claim 11, wherein the paper coating slip contains no protein.

18. A paper coating slip comprising a mineral pigment and an aqueous polymer dispersion, said polymer dispersion obtained by emulsion polymerization of at least one ethylenically unsaturated compound wherein the viscosity of the paper coating slip between 35° C. and 60° C. is at least twice the viscosity at 30° C., and one of the following constituents:

a) an ionically stabilized polymer dispersion and a polymeric compound having a temperature-dependent light transmittance, b) an aqueous polymer dispersion stabilized with a nonionic emulsifier, wherein the emulsifier has a temperature-dependent light transmittance, or c) an aqueous polymer dispersion in which the dispersed polymer contains polymerized units of a monomer whose homopolymer has a temperature-dependent light transmittance, wherein temperature-dependent light transmittance is a temperature range bounded by a lower temperature T1 and higher temperature T2 wherein the light transmittance at T2 is less than 80% of the light transmittance at T1; and wherein T1 is 30° C. and T2 ranges from 35° C. to 60° C.

19. The paper slip coating as claimed in claim 18, wherein the polymer dispersion comprises a polymer comprising polymerized units of at least 40% by weight of one or more main monomers selected from the group consisting of a $C_1$- to $C_{20}$-alkyl (meth)acrylate, a vinyl ester of carboxylic acid of up to 20 carbon atoms, a vinylaromatic of up to 20 carbon atoms, an ethylenically unsaturated nitrile, a vinyl halide, a vinyl ether of an alcohol of 1 to 10 carbon atoms, an aliphatic hydrocarbon having 2 to 8 carbon atoms and one or two double bonds and mixtures thereof.

20. The paper slip coating as claimed in claim 18, wherein the polymer dispersion comprises a polymer having a glass transition temperature of from −60° C. to +60° C.

21. The paper slip coating as claimed in claim 18, wherein the paper coating slip has a pH of greater than 7.

22. The paper slip coating as claimed in claim 18, wherein the paper coating slip comprises a) and the polymeric compound is water-soluble at 21° C. and has polyether groups.

23. The paper slip coating as claimed in claim 18, wherein the paper coating slip contains no protein.

* * * * *